US006077325A

United States Patent [19]

Margan et al.

[11] Patent Number: 6,077,325

[45] Date of Patent: Jun. 20, 2000

[54] METHOD OF ADDING COAL COMBUSTION ENHANCER TO BLAST FURNACE

[75] Inventors: Muthukumaraswamy Karanai Margan; Santanu Ghosh; Indronil Sengupta, all of Jamshedpur, India; James S. McNeill, Doylestown, Pa.

[73] Assignee: BetzDearborn Inc., Trevose, Pa.

[21] Appl. No.: 09/094,335

[22] Filed: Jun. 9, 1998

[51] Int. Cl.[7] ..... C21B 5/04

[52] U.S. Cl. ..... 75/300; 75/461; 75/471

[58] Field of Search ..... 75/300, 461, 471

[56] References Cited

U.S. PATENT DOCUMENTS

| | | | |
|---|---|---|---|
| 4,112,849 | 9/1978 | Jones | 102/103 |
| 4,188,205 | 2/1980 | Fless | 75/42 |
| 4,331,644 | 5/1982 | Ritscher | 423/437 |
| 4,375,359 | 3/1983 | Chapman et al. | 44/51 |
| 4,706,579 | 11/1987 | Merrell | 110/343 |
| 4,857,499 | 8/1989 | Ito et al. | 502/326 |

FOREIGN PATENT DOCUMENTS

| | | |
|---|---|---|
| 9213106 | 8/1992 | WIPO . |

*Primary Examiner*—Melvyn Andrews
*Attorney, Agent, or Firm*—Steven D. Boyd

[57] ABSTRACT

In the manufacture of iron in which coke and coal are added to a blast furnace during iron manufacture, an improvement for enhancing the operation of the furnace is disclosed. A metallic element in the form of a compound thereof, the metallic element selected from zirconium, chromium, molybdenum, tungsten, manganese, iron, cobalt, nickel, copper, zinc, aluminum, tin and lead is added to the coal, allowing for a reduction in the amount of coke added to the furnace.

10 Claims, No Drawings

METHOD OF ADDING COAL COMBUSTION ENHANCER TO BLAST FURNACE

BACKGROUND OF THE INVENTION

The blast furnace method for the preparation of technical grade iron or pig iron from iron ore is based essentially on the reduction of iron oxide with carbon. The carbon employed is generally in the form of coke. Due to the cost and availability of coke, this material is often partially replaced by natural gas, coal, fuel oils, etc. It is noted that it is possible to inject pulverized coal, gases or liquid petroleum products into the furnace to promote indirect reduction, increase the blast furnace output, and decrease the consumption of coke, a material that is expensive to produce and desirable to replace. Many recent developments in blast furnace technology have been centered on methods to partially replace the expensive coke with less costly substitutes. However, with modern technology, coke can be replaced to only a given extent by a liquid fuel such as crude oil, tar, residual oil, or fuel oil. Introducing these materials into a blast furnace to reduce coke consumption calls for these materials to be atomized and blown into the furnace. Unfortunately, procedures of this type often give rise to considerable soot formation which is both undesirable from a pollution standpoint and which also upsets the equilibrium of the blast furnace process.

In the blast furnace process, iron bearing materials including iron ore, sinter, scrap, or other iron source along with a fuel, generally coke, and a flux, limestone, or dolomite are charged into the blast furnace from the top. The blast furnace burns part of the fuel to produce heat for melting the iron ore and the balance of the fuel is utilized for reducing the iron and its combination with carbon. The charge in a typical furnace, per ton of pig iron produced, is about 1.7 tons of ore or other iron bearing materials, 0.5–0.65 tons of coke or other fuel, and about 0.25 tons of limestone and/or dolomite. Additionally, from 1.8–2.0 tons of air are blown into the furnace during the process.

Pulverized coal injection has been used for many years to reduce the use of coke and to enhance the operation of blast furnaces in the manufacture of pig iron. The ability to replace coke with pulverized coal in a blast furnace may reduce pollution (as less coke is needed), and may reduce the costs associated with the manufacture of iron.

In practice, iron bearing raw materials (sinter, iron ore, pellets, etc.), fuel (coke), and flux (limestone, dolomite, etc.) are charged to the top of the furnace. Heated air (blast) is blown into a blast furnace through openings, known as tuyeres, at the bottom of the furnace. Tuyere stocks are fitted with injection lances through which supplemental fuels (gas, oil and pulverized coal) are injected. The blast air burns the fuel and facilitates the smelting chemistry that produces iron. Combustion gases from the blast furnace are scrubbed to remove particulate and other noxious gases before being burned in stoves which are used to preheat blast air or in other applications, e.g., coke ovens, boilers, etc.

DETAILED DESCRIPTION OF THE PREFERRED EMBODIMENTS

While the use of pulverized coal is common practice in blast furnace operations, the present inventors have found that the ability to replace coke with coal can be greatly enhanced if a combustion catalyst/aid is added to the coal, preferably prior to its being injected into the tuyeres. Among the benefits derived from the use of a combustion catalyst/aid are the ability to use lower rank coals, the ability to replace more coke with coal, minimization of the "coal cloud" (visual effect in which pulverized coal injected into the tuyere remains visible as a dark cloud in the furnace), reduced Loss of Ignition (LOI), lowered slag content, reduced particulate emissions, and higher quality iron.

The coal combustion aid is a metallic element in the form of a compound thereof selected from the group consisting of zirconium, molybdenum, tungsten, manganese, iron, cobalt, nickel, copper, zinc, aluminum, tin and lead. In a preferred embodiment of the present invention, the metallic element is copper. In a particularly preferred embodiment, a combination of copper sulfate and a surfactant (e.g., a nonionic surfactant of the Triton® series, available from Rohn & Haas) is added to the coal.

The examples that follow demonstrate the application of the present invention.

TABLE I

Effect of Pulverized Coal Combustion Catalyst/Aid on Blast Furnace Operation

| Parameter | Units | No Combustion Catalyst/Aid | Combustion Catalyst |
|---|---|---|---|
| Coke Rate | Kg/thm | 481 | 457 |
| Coke Ash | % | 18.96 | 17.88 |
| Coal Rate | Kg/thm | 130 | 138 |
| Total Fuel | Kg/thm | 611 | 595 |
| Combustion Additive | ml/ton coal | 0 | 300–600 |
| Hot Blast Temperature | ° C. | 1160 | 1175 |
| Production Rate | tpd | 3466 | 3600 |
| Dust in Gas | $mg/Nm^3$ | 19.34 | 15.51 |

(thm: tons of hot metal)
(tpd: tons per day)

As shown in Table I above, the injection of 130 Kg/thm of pulverized coal into the tuyeres with 481 Kg/thm coke charged to the burden with a hot blast temperature of 1160° C. resulted in a total fuel rate of 611 Kg/thm, and a production rate of 3,466 tpd. Note also that the particulate matter in the flue gas was 19.34 $mg/Nm^3$.

With the addition of a combustion catalyst/aid (19% by weight of copper sulfate) sprayed as an aqueous solution on the coal prior to its being pulverized and injected into the tuyeres, the coke rate was reduced from 481 to 457 Kg/thm, while the coal rate was increased from 130 to 138 Kg/thm. In the presence of the combustion catalyst, the total fuel rate was reduced from 611 to 595 Kg/thm, with the hot blast temperature increasing from 1160 to 1175° C., and production increasing from 3466 to 3600 tpd. Note that the dust contained in the off gases decreased significantly, from 19.34 to 15.51 $mg/Nm^3$. This decrease in dust loading demonstrates the improvement in combustion, and is consistent with the visual observation that the "coal cloud" was not observed during the combustion catalyst/aid feed period.

A further evaluation was carried out, with results summarized in Table II. As shown in the Table, the addition of the combustion catalyst/aid resulted in a net reduction in total fuel rate of 23 Kg/thm. This reduction in total fuel was accompanied by significant increases in production over the base, non-catalyzed test period.

TABLE II

Effect of Pulverized Coal Combustion Catalyst/Aid on Blast Furnace Operation

| Parameter | Base Period (Without Catalyst) | Catalyst |
|---|---|---|
| Coke Rate | 470 | 459 |
| Coke Ash | 17.71 | 17.91 |
| Coal Rate | 125 | 113 |
| Total Fuel | 595 | 572 |
| Combustion Additive | 0 | 300–600 |
| Hot Blast Temperature | 1164 | 1165 |
| Production Rate | 3428 | 3617 |

(Units as defined in Table I)

As noted above, the combustion catalyst/aid was an aqueous solution containing copper sulfate. Transition metals such as copper are believed to be most active in the later flame zone by occlusion of the metal in the "soot," or unburned carbon. Occlusion of the metal subsequently accelerates oxidation in the flame zone.

It is anticipated that other materials would also be effective for purposes of the present invention. Such materials include various salts of copper, barium, cobalt, manganese, as well as alkali and alkaline earth nitrates and carbonates. Furthermore, it is expected that the metal ions specified above in conjunction with both inorganic (e.g., chloride, sulfate, carbonate, oxide, etc.) and organic (e.g., oxalate) anions, as well as organometallic compounds would also be effective.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

We claim:

1. In the manufacture of iron in which coal is added as a supplementary fuel to a blast furnace during said manufacture, a method for enhancing the operation of said furnace comprising adding to the coal an effective amount to enhance the operation of said furnace and allow for a reduction in the amount of coke added to the furnace of a combustion aid, said combustion aid being a sulfate of a metallic element selected from the group consisting of zirconium, molybdenum, tungsten, manganese, iron, cobalt, nickel, copper, zinc, aluminum, tin and lead, said method allowing for a reduction in the amount of coke added to the furnace.

2. The method as recited in claim 1 wherein said combustion aid is combined with the coal prior to addition to the blast furnace.

3. The method as recited in claim 1 wherein from about 300–600 ml of the combustion aid is added per ton of coal.

4. The method as recited in claim 1 further comprising adding a surfactant to the coal.

5. The method as recited in claim 1 wherein said metallic element is copper.

6. In the manufacture of iron in which coal is added as a supplementary fuel to a blast furnace during said manufacture, a method for enhancing the operation of said furnace comprising adding to the coal an effective amount to enhance the operation of said furnace and allow for a reduction in the amount of coke added to the furnace of a combustion aid, said combustion aid being a sulfate of copper, barium, cobalt, manganese and mixtures thereof, said method allowing for a reduction in the amount of coke added to the furnace.

7. The method as recited in claim 6 wherein said combustion aid is combined with the coal prior to addition to the blast furnace.

8. The method as recited in claim 6 wherein from about 300–600 ml of the combustion aid is added per ton of coal.

9. The method as recited in claim 6 further comprising adding a surfactant to the coal.

10. The method as recited in claim 6 wherein said combustion aid is copper sulfate.

* * * * *